US008948639B2

(12) United States Patent
Kawakami et al.

(10) Patent No.: US 8,948,639 B2
(45) Date of Patent: Feb. 3, 2015

(54) FIXING DEVICE WITH MECHANISM CAPABLE OF DETECTING PRESSURE EXERTED BETWEEN OPPOSED COMPONENTS AND IMAGE FORMING APPARATUS INCORPORATING SAME

(75) Inventors: Yoshihiro Kawakami, Hyogo (JP); Tamotsu Ikeda, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 48 days.

(21) Appl. No.: 13/491,661

(22) Filed: Jun. 8, 2012

(65) Prior Publication Data

US 2013/0004192 A1 Jan. 3, 2013

(30) Foreign Application Priority Data

Jun. 30, 2011 (JP) ..... 2011-146128

(51) Int. Cl.
*G03G 15/20* (2006.01)

(52) U.S. Cl.
CPC ..... *G03G 15/2032* (2013.01); *G03G 15/2078* (2013.01); *G03G 15/2064* (2013.01); *G03G 15/2003* (2013.01); *G03G 2215/0132* (2013.01)
USPC ..... 399/67

(58) Field of Classification Search
CPC ..... G03G 15/20
USPC ..... 399/64, 67, 122, 328
See application file for complete search history.

(56) References Cited

U.S. PATENT DOCUMENTS 4,232,959 A * 11/1980 Ateya et al. ..... 399/67
4,269,594 A * 5/1981 Umans et al. ..... 432/59
4,802,439 A * 2/1989 Sugimoto et al. ..... 118/116
4,873,553 A * 10/1989 Inaba ..... 399/67
6,201,938 B1 * 3/2001 Hollar et al. ..... 399/67
6,347,585 B1 * 2/2002 Kiamco et al. ..... 101/351.1
6,647,215 B1 * 11/2003 Ogle et al. ..... 399/13
6,647,216 B2 * 11/2003 Tanaka ..... 399/21
7,280,775 B2 * 10/2007 Kubochi et al. ..... 399/33

(Continued)

FOREIGN PATENT DOCUMENTS

EP 2328038 * 8/2009 ..... G03G 15/20
JP 61294475 * 12/1986 ..... G03G 15/20

(Continued)

*Primary Examiner* — Clayton E Laballe
*Assistant Examiner* — Kevin Butler
(74) *Attorney, Agent, or Firm* — Harness, Dickey & Pierce P.L.C.

(57) ABSTRACT

A fixing device includes a pressurization member connected to a pressing rotary body to press the pressing rotary body against a fixing rotary body; a depressurization assembly interposed between the pressing rotary body and the pressurization member and movable between a reduced pressure position where the depressurization assembly causes the pressurization member to press the pressing rotary body against the fixing rotary body with reduced pressure therebetween and an enhanced pressure position where the depressurization assembly is free from pressure from the pressurization member to cause the pressurization member to press the pressing rotary body against the fixing rotary body with enhanced pressure therebetween; a positioner separatably contacting the depressurization assembly to immovably halt the depressurization assembly at the enhanced pressure position; and a position detector separatably contacting the depressurization assembly to detect the position of the depressurization assembly.

20 Claims, 9 Drawing Sheets

(56) References Cited

U.S. PATENT DOCUMENTS

| | | | | |
|---|---|---|---|---|
| 7,668,494 | B2 * | 2/2010 | Kubo et al. | 399/328 |
| 8,073,351 | B2 * | 12/2011 | Hayamizu | 399/67 |
| 8,107,864 | B2 | 1/2012 | Saito et al. | |
| 8,295,725 | B2 * | 10/2012 | Takahashi | 399/67 |
| 8,447,199 | B2 * | 5/2013 | Ueno et al. | 399/67 |
| 2002/0127022 | A1 * | 9/2002 | Tanaka | 399/16 |
| 2007/0014585 | A1 * | 1/2007 | Nagasu et al. | 399/67 |
| 2007/0019977 | A1 * | 1/2007 | Sawamura et al. | 399/67 |
| 2007/0104503 | A1 * | 5/2007 | Kubo et al. | 399/67 |
| 2009/0110448 | A1 * | 4/2009 | Hiraoka et al. | 399/328 |
| 2009/0110449 | A1 | 4/2009 | Saito et al. | |
| 2009/0129836 | A1 | 5/2009 | Sakaya et al. | |
| 2009/0180792 | A1 * | 7/2009 | Hayamizu | 399/67 |
| 2010/0034548 | A1 | 2/2010 | Naitoh et al. | |
| 2010/0189478 | A1 * | 7/2010 | Takahashi | 399/331 |
| 2010/0239297 | A1 | 9/2010 | Sakaya et al. | |
| 2012/0002997 | A1 * | 1/2012 | Hiraoka et al. | 399/92 |
| 2012/0027477 | A1 * | 2/2012 | Nakayama | 399/328 |
| 2012/0093531 | A1 * | 4/2012 | Yuasa et al. | 399/67 |
| 2012/0114352 | A1 * | 5/2012 | Miyoshi | 399/67 |
| 2012/0121293 | A1 * | 5/2012 | Mimbu et al. | 399/121 |
| 2012/0195652 | A1 | 8/2012 | Takahashi et al. | |
| 2013/0004192 | A1 * | 1/2013 | Kawakami et al. | 399/67 |
| 2013/0004217 | A1 * | 1/2013 | Ikeda et al. | 399/328 |

FOREIGN PATENT DOCUMENTS

| | | | | | |
|---|---|---|---|---|---|
| JP | 61294475 | A | | 12/1986 | |
| JP | H10260607 | | * | 9/1998 | G03G 15/20 |
| JP | H1165350 | | * | 3/1999 | G03G 15/20 |
| JP | 2002139948 | A | | 5/2002 | |
| JP | 2009-139682 | | * | 6/2009 | G03G 15/20 |
| JP | 2009139682 | A | | 6/2009 | |
| JP | 2009244514 | A | | 10/2009 | |

* cited by examiner

FIXING DEVICE WITH MECHANISM CAPABLE OF DETECTING PRESSURE EXERTED BETWEEN OPPOSED COMPONENTS AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-146128, filed on Jun. 30, 2011, in the Japanese Patent Office, the entire disclosure of which is hereby incorporated by reference herein.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing roller heated by a heater and a pressing roller pressed against the fixing roller by a spring to form a fixing nip therebetween through which a recording medium bearing an unfixed toner image is conveyed. As the recording medium passes through the fixing nip, the fixing roller heated by the heater and the pressing roller apply heat and pressure to the recording medium, thus melting and fixing the toner image on the recording medium.

Various types of recording media are available in the fixing device. However, if an envelope is conveyed through the fixing nip under enhanced pressure identical to pressure appropriate for fixing the toner image on plain paper, the envelope may crease. Further, if the pressing roller is pressed against the fixing roller with enhanced pressure constantly, the pressing roller and the fixing roller may suffer from permanent deformation. Moreover, if a recording medium is jammed between the fixing roller and the pressing roller, it may be difficult for the user to remove the jammed recording medium from between the fixing roller and the pressing roller pressed against the fixing roller with enhanced pressure appropriate for fixing the toner image on the recording medium. To address these problems, the fixing device may employ a depressurization mechanism that decreases pressure between the fixing roller and the pressing roller as shown in FIGS. 1 and 2.

FIGS. 1 and 2 illustrate a fixing device 20R incorporating a lever 400 serving as a depressurization mechanism that decreases pressure between a fixing roller 200 and a pressing roller 300. As shown in FIG. 1, the pressing roller 300 supported by a support 500 receives a resilient bias from a biasing member 600 via the support 500 and thereby is pressed against the fixing roller 200 with enhanced pressure therebetween. As the user rotates the lever 400 clockwise in FIG. 2 in the direction of the arrow to press the lever 400 against the support 500 against the resilient bias exerted by the biasing member 600, the pressing roller 300 is pressed against the fixing roller 200 with reduced pressure therebetween.

However, in order to solve the above-described problems, it is necessary to detect pressure between the fixing roller 200 and the pressing roller 300 precisely. For example, the fixing device 20R may employ a sensor that detects the position of the lever 400. When the lever 400 is at the reduced pressure position shown in FIG. 2, it is immovable there while receiving the resilient bias from the biasing member 600. Conversely, when the lever 400 is at the enhanced pressure position shown in FIG. 1, the lever 400 is free from the resilient bias from the biasing member 600 and therefore idly rotatable. Accordingly, the sensor may not detect the enhanced pressure position of the lever 400 precisely, resulting in erroneous detection of pressure between the fixing roller 200 and the pressing roller 300 that may raise the problems described above. If an optical sensor providing a limited detection range of from about 2 mm to about 3 mm is used, erroneous detection may occur frequently.

SUMMARY OF THE INVENTION

At least one embodiment may provide a fixing device that includes a fixing rotary body rotatable in a predetermined direction of rotation and a pressing rotary body pressed against the fixing rotary body to form a fixing nip therebetween through which a recording medium bearing a toner image is conveyed. A pressurization member is connected to the pressing rotary body to press the pressing rotary body against the fixing rotary body. A depressurization assembly is interposed between the pressing rotary body and the pressurization member and movable between a reduced pressure position where the depressurization assembly causes the pressurization member to press the pressing rotary body against the fixing rotary body with reduced pressure therebetween and an enhanced pressure position where the depressurization assembly is free from pressure from the pressurization member to cause the pressurization member to press the pressing rotary body against the fixing rotary body with enhanced pressure therebetween. A positioner separatably contacts the depressurization assembly to immovably halt the depressurization assembly at the enhanced pressure position. A position detector separatably contacts the depressurization assembly to detect the position of the depressurization assembly.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
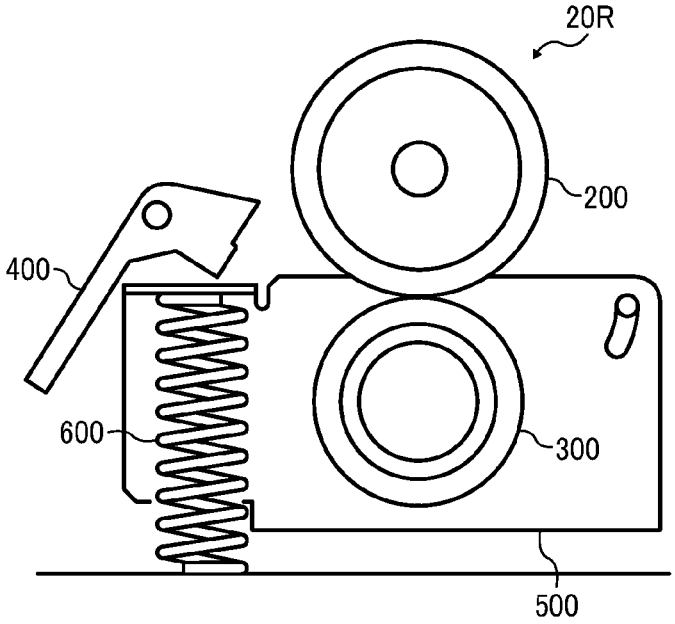
FIG. 1 RELATED ART
FIG. 1 is a schematic vertical sectional view of a related-art fixing device in an enhanced pressure state in which a pressing roller presses against a fixing roller with enhanced pressure therebetween.
Figure 2:
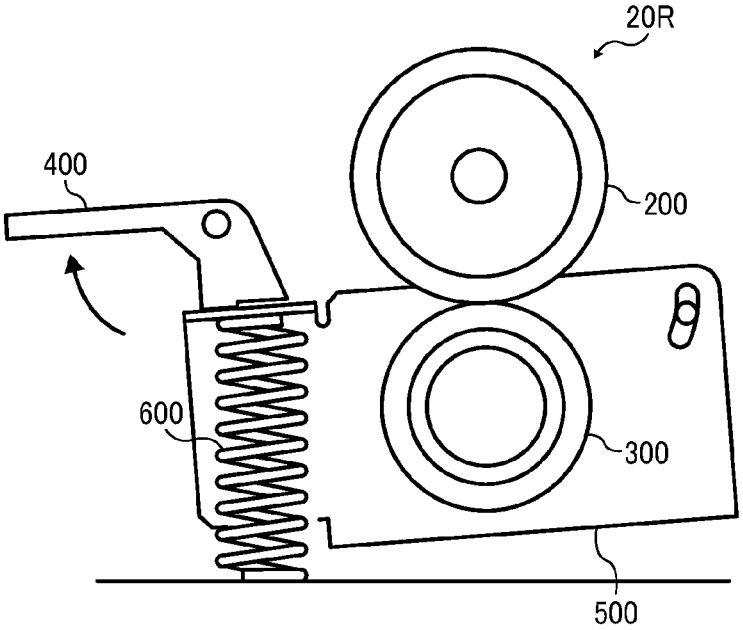
FIG. 2 RELATED ART
FIG. 2 is a schematic vertical sectional view of the related-art fixing device in a reduced pressure state in which the pressing roller presses against the fixing roller with reduced pressure therebetween.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
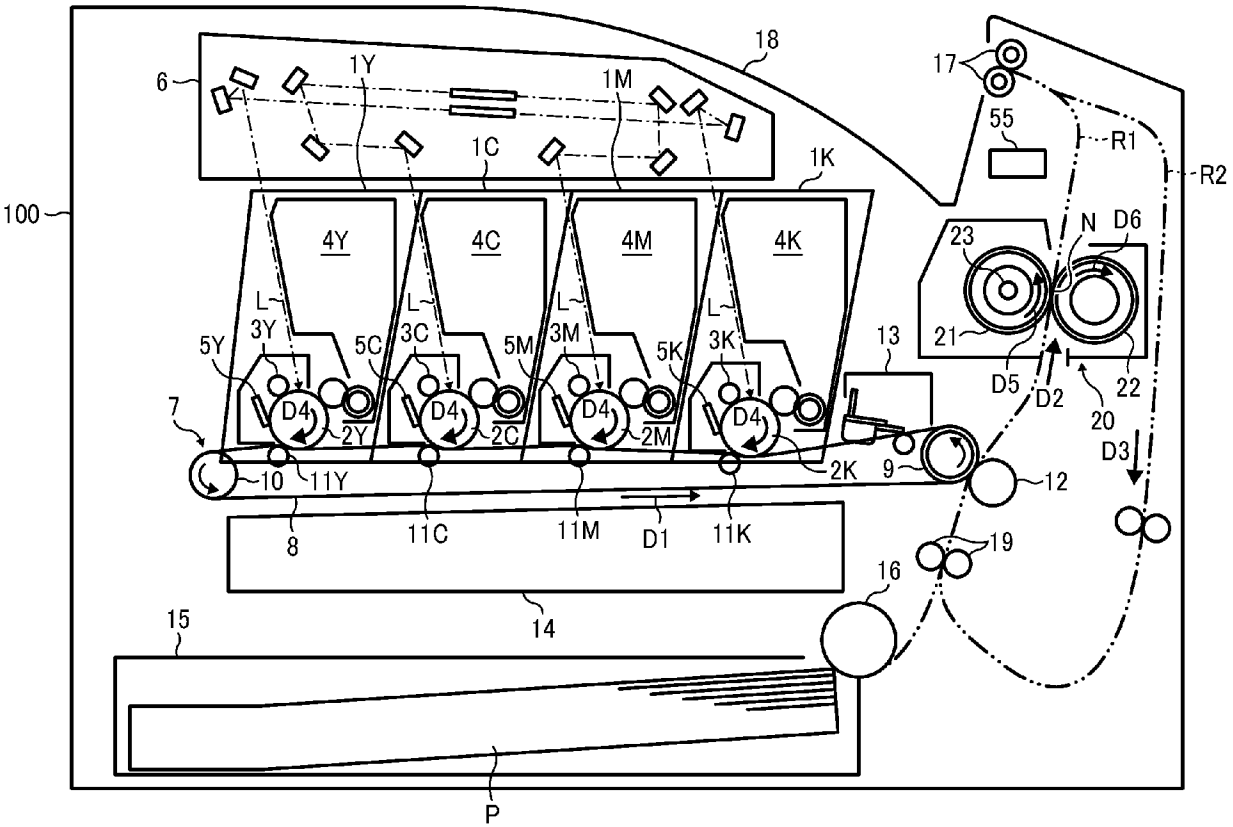
FIG. 3 is a schematic vertical sectional view of an image forming apparatus according to an example embodiment of the present invention.

Referring now to the drawings, wherein like reference numerals designate identical or corresponding parts throughout the several views, particularly to FIG. 3, an image forming apparatus 100 according to an example embodiment is explained.

FIG. 3 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this example embodiment, the image forming apparatus 100 is a color printer for forming a color toner images on a recording medium by electrophotography.

Referring to FIG. 3, the following describes the structure of the image forming apparatus 100.

The image forming apparatus 100 includes four process units 1Y, 1C, 1M, and 1K serving as image forming units detachably attached to the image forming apparatus 100. Although the process units 1Y, 1C, 1M, and 1K contain yellow, cyan, magenta, and black developers that form yellow, cyan, magenta, and black toner images, respectively, resulting in a color toner image, they have an identical structure. Hence, the following describes the structure of one of them, that is, the process unit 1Y that forms a yellow toner image. The developer used in the process units 1Y, 1C, 1M, and 1K may be a one-component developer that contains toner or a two-component developer that contains toner and carrier particles.

For example, the process unit 1Y includes a drum-shaped photoconductor 2Y serving as an image carrier that carries an electrostatic latent image and a resultant yellow toner image; a charging roller 3Y serving as a charger that charges an outer circumferential surface of the photoconductor 2Y; a development device 4Y serving as a development unit that supplies a developer (e.g., yellow toner) to the electrostatic latent image formed on the outer circumferential surface of the photoconductor 2Y thus visualizing the electrostatic latent image into a yellow toner image with the yellow toner; and a cleaning blade 5Y serving as a cleaner that cleans the outer circumferential surface of the photoconductor 2Y. Alternatively, the photoconductors 2Y, 2C, 2M, and 2K may be an endless belt instead of a drum.

Above the process units 1Y, 1C, 1M, and 1K is an exposure device 6 serving as an exposure unit that emits a laser beam L onto the outer circumferential surface of the respective photoconductors 2Y, 2C, 2M, and 2K to form an electrostatic latent image thereon. For example, the exposure device 6, constructed of a light source, a polygon mirror, an f-θ lens, reflection mirrors, and the like, emits a laser beam L onto the outer circumferential surface of the respective photoconductors 2Y, 2C, 2M, and 2K according to image data sent from an external device such as a client computer.

Below the process units 1Y, 1C, 1M, and 1K is a transfer unit 7 that accommodates an endless intermediate transfer belt 8 serving as a transferor, a driving roller 9, a driven roller 10, four primary transfer rollers 11Y, 11C, 11M, and 11K, a secondary transfer roller 12, and a belt cleaner 13. Specifically, the endless intermediate transfer belt 8 is stretched over the driving roller 9 and the driven roller 10 that support the intermediate transfer belt 8. As the driving roller 9 rotates counterclockwise in FIG. 3, the intermediate transfer belt 8 rotates counterclockwise in FIG. 3 in a rotation direction D1.

Inside a loop formed by the intermediate transfer belt 8 and opposite the four photoconductors 2Y, 2C, 2M, and 2K are the four primary transfer rollers 11Y, 11C, 11M, and 11K serving as primary transferors that transfer the yellow, cyan, magenta, and black toner images formed on the photoconductors 2Y, 2C, 2M, and 2K, respectively, onto an outer circumferential surface of the intermediate transfer belt 8. The primary transfer rollers 11Y, 11C, 11M, and 11K contact an inner circumferential surface of the intermediate transfer belt 8 and press the intermediate transfer belt 8 against the photoconductors 2Y, 2C, 2M, and 2K at opposed positions where the primary transfer rollers 11Y, 11C, 11M, and 11K are disposed opposite the photoconductors 2Y, 2C, 2M, and 2K, respectively, via the intermediate transfer belt 8, thus forming primary transfer nips between the photoconductors 2Y, 2C, 2M, and 2K and the intermediate transfer belt 8 where the yellow, cyan, magenta, and black toner images formed on the photoconductors 2Y, 2C, 2M, and 2K are primarily transferred onto the intermediate transfer belt 8 to form a color toner image thereon. The primary transfer rollers 11Y, 11C, 11M, and 11K are connected to a power supply that applies a predetermined direct current voltage and/or alternating voltage thereto.

Opposite the driving roller 9 is the secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto the recording medium P. Similar to the primary transfer rollers 11Y, 11C, 11M, and 11K, the secondary transfer roller 12 is connected to a power supply that applies a predetermined direct current voltage and/or alternating voltage thereto.

The belt cleaner 13, disposed opposite the outer circumferential surface of the intermediate transfer belt 8 and in proximity to the secondary transfer nip, cleans the outer circumferential surface of the intermediate transfer belt 8. Below the intermediate transfer unit 7 is a waste toner container 14 that collects waste toner conveyed from the belt cleaner 13 through a waste toner conveyance tube extending from the belt cleaner 13 to an inlet of the waste toner container 14.

In a lower portion of the image forming apparatus 100 are a paper tray 15 that loads a plurality of recording media P (e.g., sheets) and a feed roller 16 that picks up and feeds a recording medium P from the paper tray 15 toward the secondary transfer nip formed between the secondary transfer roller 12 and the intermediate transfer belt 8. The recording media P may be thick paper, postcards, envelopes, plain paper, thin paper, coated paper, tracing paper, OHP (overhead projector) transparencies, OHP film sheets, and the like. Additionally, a bypass tray may be attached to the image forming apparatus 100 that loads postcards, envelopes, OHP transparencies, OHP film sheets, and the like.

In an upper portion of the image forming apparatus 100 are an output roller pair 17 that discharges the recording medium P onto an outside of the image forming apparatus 100 and an output tray 18 that receives and stocks the recording medium P discharged by the output roller pair 17.

The recording medium P fed by the feed roller 16 is conveyed upward through a conveyance path R1 that extends from the paper tray 15 to the output roller pair 17 through the secondary transfer nip formed between the secondary transfer roller 12 and the intermediate transfer belt 8. The conveyance path R1 is provided with a registration roller pair 19 located below the secondary transfer nip formed between the secondary transfer roller 12 and the intermediate transfer belt 8, that is, upstream from the secondary transfer nip in a recording medium conveyance direction D2. The registration roller pair 19 feeds the recording medium P conveyed from the feed roller 16 toward the secondary transfer nip. The conveyance path R1 is further provided with a fixing device 20 located above the secondary transfer nip, that is, downstream from the secondary transfer nip in the recording medium conveyance direction D2. The fixing device 20 fixes the color toner image on the recording medium P. For example, the fixing device 20 (e.g., a fuser unit) includes a fixing roller 21 serving as a fixing rotary body; a pressing roller 22 serving as a pressing rotary body pressed against the fixing roller 21 to form a fixing nip N therebetween through which the recording medium P bearing the color toner image is conveyed. A heater 23 is disposed inside the fixing roller 21 to heat it.

A reverse path R2 extends from a bifurcation position upstream from the output roller pair 17 to a joint position downstream from the feed roller 16 in a recording medium conveyance direction D3 to reverse and convey the recording medium P for duplex printing. The reverse path R2 separates from the conveyance path R1 at the bifurcation position upstream from the output roller pair 17 in the recording medium conveyance direction D2 and joins the conveyance path R1 at the joint position upstream from the registration roller pair 19 in the recording medium conveyance direction D2. During duplex printing, the output roller pair 17 switches back the recording medium P conveyed through the conveyance path R1 and feeds it toward the reverse path R2.

Referring to FIG. 3, the following describes an operation of the image forming apparatus 100 having the structure described above to form a color toner image on a recording medium P.

As a print job starts, a driver drives and rotates the photoconductors 2Y, 2C, 2M, and 2K of the process units 1Y, 1C, 1M, and 1K, respectively, clockwise in FIG. 3 in a rotation direction D4. The charging rollers 3Y, 3C, 3M, and 3K uniformly charge the outer circumferential surface of the respective photoconductors 2Y, 2C, 2M, and 2K at a predetermined polarity. The exposure device 6 emits laser beams L onto the charged outer circumferential surface of the respective photoconductors 2Y, 2C, 2M, and 2K according to yellow, cyan, magenta, and black image data contained in image data sent from the external device, respectively, thus forming electrostatic latent images thereon. The development devices 4Y, 4C, 4M, and 4K supply yellow, cyan, magenta, and black toners to the electrostatic latent images formed on the photoconductors 2Y, 2C, 2M, and 2K, visualizing the electrostatic latent images into yellow, cyan, magenta, and black toner images, respectively.

As the driving roller 9 is driven and rotated counterclockwise in FIG. 3, the driving roller 9 drives and rotates the intermediate transfer belt 8 counterclockwise in FIG. 3 in the rotation direction D1. The power supply applies a constant voltage or a constant current control voltage having a polarity opposite a polarity of toner to the primary transfer rollers 11Y, 11C, 11M, and 11K. Thus, a transfer electric field is created at the primary transfer nips formed between the primary transfer rollers 11Y, 11C, 11M, and 11K and the photoconductors 2Y, 2C, 2M, and 2K, respectively. Accordingly, the yellow, cyan, magenta, and black toner images formed on the photoconductors 2Y, 2C, 2M, and 2K, respectively, are primarily transferred onto the intermediate transfer belt 8 successively by the transfer electric field created at the respective primary transfer nips, in such a manner that the yellow, cyan, magenta, and black toner images are superimposed on a same position on the intermediate transfer belt 8. Consequently, a color toner image is formed on the intermediate transfer belt 8.

After the primary transfer of the yellow, cyan, magenta, and black toner images from the photoconductors 2Y, 2C, 2M, and 2K onto the intermediate transfer belt 8, the cleaning blades 5Y, 5C, 5M, and 5K remove residual toner not transferred onto the intermediate transfer belt 8 and therefore remaining on the photoconductors 2Y, 2C, 2M, and 2K therefrom. Then, dischargers discharge the outer circumferential surface of the respective photoconductors 2Y, 2C, 2M, and 2K, initializing the potential thereof so that the respective photoconductors 2Y, 2C, 2M, and 2K are ready for the next print job.

On the other hand, as the print job starts, the feed roller 16 is driven and rotated to feed a recording medium P from the paper tray 15 toward the registration roller pair 19 through the conveyance path R1. The registration roller pair 19 feeds the recording medium P to the secondary transfer nip formed between the secondary transfer roller 12 and the intermediate transfer belt 8 at a time when the color toner image formed on the intermediate transfer belt 8 reaches the secondary transfer nip. The secondary transfer roller 12 is applied with a transfer voltage having a polarity opposite a polarity of the charged yellow, cyan, magenta, and black toners of the yellow, cyan, magenta, and black toner images constituting the color toner image formed on the intermediate transfer belt 8, thus creating a transfer electric field at the secondary transfer nip. Accordingly, the yellow, cyan, magenta, and black toner images constituting the color toner image are secondarily transferred from the intermediate transfer belt 8 collectively onto the recording medium P by the transfer electric field created at the secondary transfer nip. Alternatively, the power supply may apply a voltage having the same polarity as the polarity of toner to the driving roller 9 disposed opposite the secondary transfer roller 12, creating the transfer electric field at the secondary transfer nip.

After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. The removed toner is collected into the waste toner container 14 through the waste toner conveyance tube.

The recording medium P bearing the color toner image is conveyed to the fixing device 20 where the fixing roller 21 and the pressing roller 22 apply heat and pressure to the recording medium P, fixing the color toner image on the recording medium P. Thereafter, the recording medium P bearing the fixed color toner image is conveyed to the output roller pair 17 that discharges the recording medium P onto the output tray 18.

If a user selects duplex printing, as a leading edge of the recording medium P bearing the fixed toner image on a front side thereof is nipped by the output roller pair 17 and at the same time a trailing edge of the recording medium P passes through the bifurcation position where the conveyance path R1 bifurcates into a path extending to the output roller pair 17 and the reverse path R2, the output roller pair 17 rotates backward, switching back the recording medium P to the reverse path R2. A switch pawl situated in proximity to the bifurcation position moves and creates the path through which the recording medium P is to be conveyed: the path extending to the output roller pair 17 or the reverse path R2. After the recording medium P is conveyed through the reverse path R2, it enters the conveyance path R1 in a state in which the recording medium P is reversed so that the front side thereof bearing the fixed toner image faces the secondary transfer roller 12. Accordingly, as the recording medium P passes through the secondary transfer nip, another toner image formed on the intermediate transfer belt 8 is transferred onto a back side of the recording medium P. Thereafter, as the recording medium P is conveyed through the fixing device 20, the toner image is fixed on the back side of the recording medium P, and then the recording medium P bearing the toner image on both sides thereof is discharged onto the output tray 18.

The above describes the image forming operation of the image forming apparatus 100 to form the color toner image on the recording medium P. Alternatively, the image forming apparatus 100 may form a monochrome toner image by using any one of the four process units 1Y, 1C, 1M, and 1K or may form a bicolor or tricolor toner image by using two or three of the process units 1Y, 1C, 1M, and 1K.

Referring to FIG. 3, the following describes a construction of the fixing device 20 installed in the image forming apparatus 100 described above.

As described above, the fixing device 20 includes the fixing roller 21 serving as a fixing rotary body rotatable in a rotation direction D5 and the pressing roller 22 serving as a pressing rotary body rotatable in a rotation direction D6 counter to the rotation direction D5 of the fixing roller 21.

A detailed description is now given of a construction of the fixing roller 21.

The fixing roller 21 is constructed of a tube, an elastic layer coating the tube, and a release layer coating the elastic layer.

For example, the tube is made of a metal material such as aluminum or iron and has a thickness of about 1 mm and an outer loop diameter of about 30 mm. The elastic layer is made of silicone rubber, fluoro rubber, silicone rubber foam, or the like and has a thickness of about 1 mm. The release layer is made of tetrafluoroethylene-perfluoroalkyl vinyl ether copolymer (PFA), polytetrafluoroethylene (PTFE), or the like and has a thickness of about a few tens of micro meters.

The heater 23 is situated inside the tube of the fixing roller 21. The heater 23 is a halogen heater, ambilateral ends of which in a longitudinal direction thereof are mounted on a frame of the fixing device 20. A power supply (e.g., an alternating current power supply) situated inside the image forming apparatus 100 supplies power to the heater 23 so that the heater 23 generates radiation heat that heats the tube of the fixing roller 21. Heat is conducted from the tube to the elastic layer and the release layer of the fixing roller 21 and finally to the toner image on the recording medium P.

A thermopile serving as a temperature detector that detects the temperature of the fixing roller 21 is disposed opposite an outer circumferential surface of the fixing roller 21 with a predetermined interval therebetween. A controller 55, that is, a central processing unit (CPU) provided with a random-access memory (RAM) and a read-only memory (ROM), for example, is operatively connected to the thermopile and the heater 23 to control the heater 23 based on the temperature of the fixing roller 21 detected by the thermopile. Specifically, the power supply applies an alternating voltage to the heater 23 for an energization time determined by the controller 55 based on the temperature of the fixing roller 21 detected by the thermopile. Thus, the heater 23 heats the fixing roller 21 to a target fixing temperature. A driver (e.g., a motor) connected to the fixing roller 21 drives and rotates the fixing roller 21.

A detailed description is now given of a construction of the pressing roller 22.

The pressing roller 22 is constructed of a metal core and an elastic layer coating the metal core. For example, the elastic layer is made of silicone rubber, fluoro rubber, silicone rubber foam, or the like and has a thickness of about 4 mm. The pressing roller 22 has an outer loop diameter of about 35 mm. Alternatively, a release layer made of PFA, PTFE, or the like may coat the elastic layer. A pressurization member described below presses the pressing roller 22 against the fixing roller 21, forming the fixing nip N between the pressing roller 22 and the fixing roller 21. Another heater may be situated inside and/or outside the pressing roller 22 to heat it directly. Additionally, a thermistor may contact the outer circumferential surface of the fixing roller 21 to control output of the heater 23.

A guide plate is disposed in proximity to an entry to the fixing nip N to guide the recording medium P to the fixing nip N. A separator plate is disposed in proximity to an exit of the fixing nip N to separate the recording medium P discharged from the fixing nip N from the fixing roller 21, preventing the recording medium P from being wound around the fixing roller 21.

Referring to FIG. 3, the following describes an operation of the fixing device 20 having the construction described above to fix a toner image on a recording medium P.

As the user turns on a power switch of the image forming apparatus 100, the alternating current power supply applies an alternating voltage to the heater 23 and the driver drives and rotates the fixing roller 21 in the rotation direction D5 which in turn rotates the pressing roller 22 in the rotation direction D6. Thereafter, a recording medium P is conveyed from the paper tray 15 to the secondary transfer nip where a toner image is transferred from the intermediate transfer belt 8 onto the recording medium P. As the recording medium P bearing the toner image is conveyed through the fixing nip N of the fixing device 20 formed between the fixing roller 21 and the pressing roller 22, heat from the fixing roller 21 and pressure from the fixing roller 21 and the pressing roller 22 fix the toner image on the recording medium P. Thereafter, the fixing roller 21 and the pressing roller 22 feed the recording medium P from the fixing nip N toward the output roller pair 17 that discharges the recording medium P onto the output tray 18.

Figure 4:
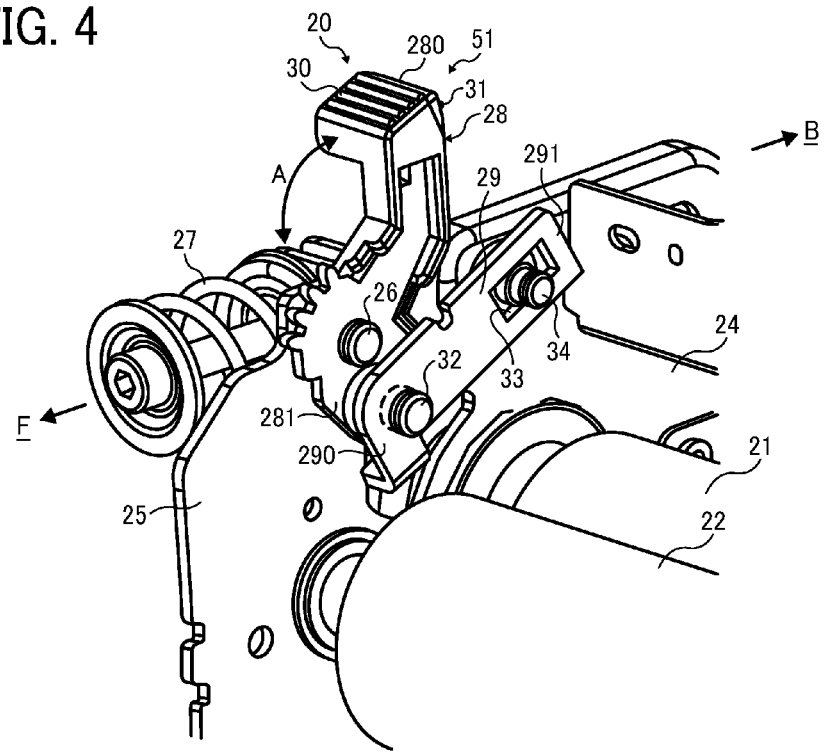
FIG. 4 is a partial perspective view of a fixing device incorporated in the image forming apparatus shown in FIG. 3 in an enhanced pressure state in which a pressing roller presses against a fixing roller with enhanced pressure therebetween.

Referring to FIG. 4, the following describes a construction of a depressurization assembly 51 installed in the fixing device 20 described above.

FIG. 4 is a partial perspective view of the fixing device 20 illustrating one end of the fixing device 20 in an axial direction of the fixing roller 21 in a state in which a housing of the fixing device 20 is removed. As shown in FIG. 4, the fixing roller 21 is rotatably supported by a fixing plate 24 serving as a support that supports the fixing roller 21. Similarly, the pressing roller 22 is rotatably supported by a pressing plate 25 serving as a support that supports the pressing roller 22. The fixing plate 24 is coupled with the pressing plate 25 through a support shaft located in a lower portion of the fixing plate 24 and the pressing plate 25 in such a manner that the pressing plate 25 is swingable about the support shaft. Accordingly, the pressing roller 22 rotatably mounted on the pressing plate 25 comes into contact with and separates from the fixing roller 21 rotatably mounted on the fixing plate 24.

According to this example embodiment, the fixing plate 24 is stationarily disposed inside the image forming apparatus 100 depicted in FIG. 3 and the pressing plate 25 is swingable about the support shaft. Alternatively, the pressing plate 25 may be stationarily disposed inside the image forming apparatus 100 and the fixing plate 24 may be swingable about the support shaft. Yet alternatively, both the fixing plate 24 and the pressing plate 25 may be swingable.

A spring 27 is attached to the fixing plate 24 and the pressing plate 25 to move the pressing plate 25 closer to the fixing plate 24, thus serving as a pressurization member that presses the pressing roller 22 against the fixing roller 21. For example, the spring 27 biases the pressing roller 22 rotatably mounted on the pressing plate 25 against the fixing roller 21 rotatably mounted on the fixing plate 24 to press the pressing roller 22 against the fixing roller 21, thus forming the fixing nip N therebetween. According to this example embodiment, a compression spring is used as the spring 27. Alternatively, a tension spring may be used as the spring 27.

Conversely, the depressurization assembly 51 depressurizes pressure exerted at the fixing nip N formed between the fixing roller 21 and the pressing roller 22. For example, the depressurization assembly 51 is constructed of a lever 28 operated by the user and a depressurization member 29 (e.g., a depressurization plate) swingably mounted on the lever 28 to move in accordance with movement of the lever 28, thus depressurizing pressure exerted at the fixing nip N.

The lever 28 is rotatably supported by a support shaft 26 mounted on the pressing plate 25. A head 280, that is, a free end, of the lever 28 is swingable about the support shaft 26 in a direction A. For example, the lever 28 is swingable in a frontward direction F toward the user and a rearward direction B opposite the frontward direction F. The head 280 of the lever 28 mounts anti-slippage sheets 30 and 31 having a plurality of pits and projections that help the user catch the lever 28.

A fixed end 281, that is, another end of the lever 28 opposite the head 280, of the lever 28 is rotatably supported by a support shaft 32. A fixed end 290 of the depressurization member 29 is also rotatably supported by the support shaft 32. Thus, the depressurization member 29 is rotatable about the support shaft 32 that supports the lever 28 and the depressurization member 29. A free end 291, that is, another end of the depressurization member 29 opposite the fixed end 290, is provided with a rectangular elongate through-hole 33 into which a shaft 34 mounted on the fixing plate 24 is inserted.

FIG. 4 illustrates one end of the fixing device 20 in the axial direction of the fixing roller 21. Although not shown, another end of the fixing device 20 in the axial direction of the fixing roller 21 has a construction equivalent to that of the one end of the fixing device 20 shown in FIG. 4.

Figure 5:
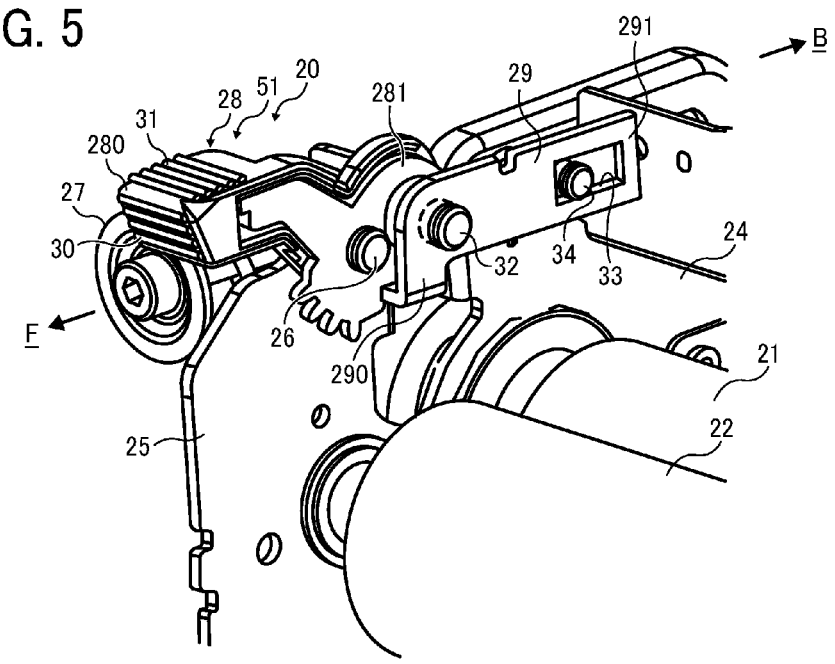
FIG. 5 is a partial perspective view of the fixing device shown in FIG. 4 in a reduced pressure state in which the pressing roller presses against the fixing roller with reduced pressure therebetween.

Referring to FIGS. 4 and 5, the following describes a depressurization operation of the depressurization assembly 51 having the construction described above.

FIG. 4 is a partial perspective view of the fixing device 20 in an enhanced pressure state in which the pressing roller 22 presses against the fixing roller 21 with enhanced pressure therebetween. FIG. 5 is a partial perspective view of the fixing device 20 in a reduced pressure state in which the pressing roller 22 presses against the fixing roller 21 with reduced pressure therebetween.

As the user swings the lever 28 in the frontward direction F from an enhanced pressure position shown in FIG. 4 to a reduced pressure position shown in FIG. 5 and therefore the lever 28 extends horizontally, the depressurization member 29 also extends horizontally in accordance with movement of the lever 28. Accordingly, the depressurization member 29 engaging the shaft 34 mounted on the fixing plate 24 exerts a bias to the pressing plate 25, separating the pressing plate 25 from the fixing plate 24 against a resilient bias exerted by the spring 27. Consequently, the pressing roller 22 mounted on the pressing plate 25 separates from the fixing roller 21 mounted on the fixing plate 24, thus decreasing pressure between the fixing roller 21 and the pressing roller 22.

According to this example embodiment, the depressurization assembly 51 decreases pressure between the fixing roller 21 and the pressing roller 22 while the pressing roller 22 contacts the fixing roller 21. Alternatively, the depressurization assembly 51 may be configured to isolate the pressing roller 22 from the fixing roller 21.

Figure 6:
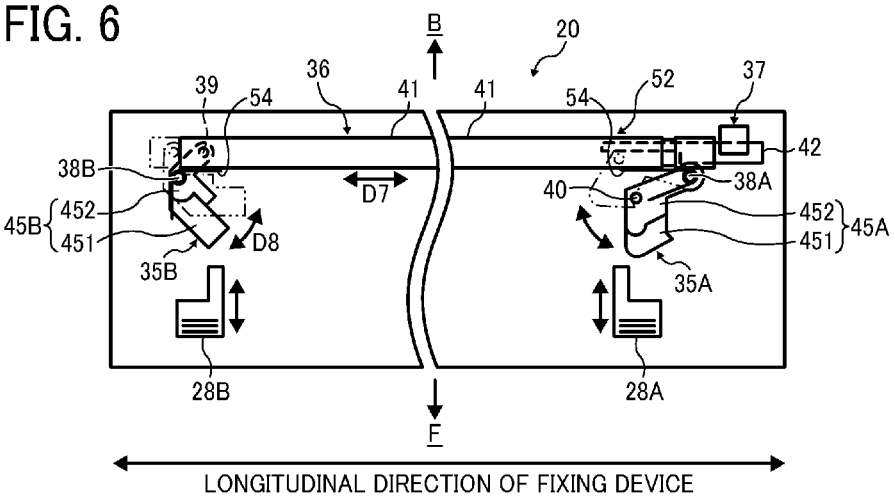
FIG. 6 is a plan view of the fixing device shown in FIG. 4.
Figure 7:
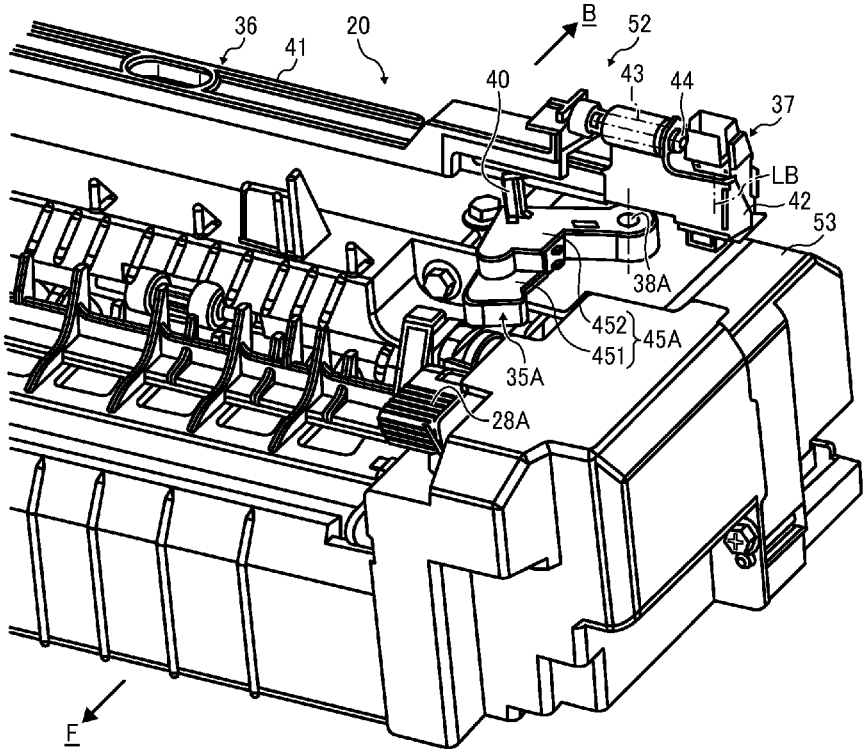
FIG. 7 is an external perspective view of one end of the fixing device shown in FIG. 6 in a longitudinal direction thereof.
Figure 8:
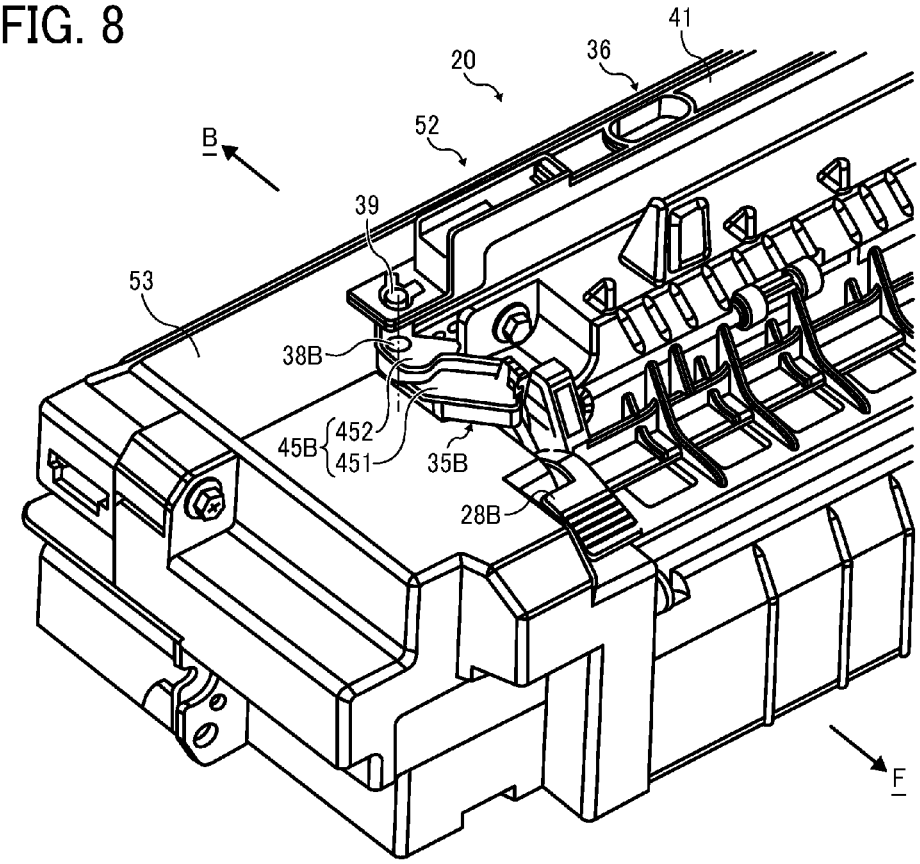
FIG. 8 is an external perspective view of another end of the fixing device shown in FIG. 6 in the longitudinal direction thereof.

Referring to FIGS. 6 to 8, the following describes a configuration of a position detector 52 incorporated in the fixing device 20 that detects the position of the depressurization assembly 51 described above.

FIG. 6 is a plan view of the fixing device 20. FIG. 7 is an external perspective view of one end of the fixing device 20 in a longitudinal direction thereof FIG. 8 is an external perspective view of another end of the fixing device 20 in the longitudinal direction thereof FIGS. 6 to 8 illustrate levers 28A and 28B represented by the lever 28 shown in FIG. 4.

As shown in FIG. 6, the position detector 52 includes two rotary members 35A and 35B, a single linear movement assembly 36, and a single sensor 37. The two rotary members 35A and 35B are located at ambilateral ends of the fixing device 20 in the longitudinal direction thereof parallel to the axial direction of the fixing roller 21, respectively. The linear movement assembly 36 extends in the longitudinal direction of the fixing device 20. The sensor 37 is located at a right end of the fixing device 20 in FIG. 6 in the longitudinal direction thereof. As shown in FIGS. 7 and 8, the rotary members 35A and 35B, the linear movement assembly 36, and the sensor 37 are disposed atop a housing 53 of the fixing device 20.

As shown in FIG. 6, the rotary members 35A and 35B are rotatable about axes 38A and 38B, respectively. The linear movement assembly 36 is movable linearly back and forth in a direction D7 along the longitudinal direction of the fixing device 20. A left end in FIG. 6 of the linear movement assembly 36 is connected to the rotary member 35B. Hence, as the rotary member 35B is rotated in a rotation direction D8 by the lever 28B, the linear movement assembly 36 moves in the direction D7 in accordance with rotation of the rotary member 35B.

As shown in FIG. 7, a projection 40 is mounted on a top face of the rotary member 35A and projects from the rotary member 35A vertically. As shown in FIG. 8, a support shaft 39 is mounted on a top face of the rotary member 35B and projects from the rotary member 35B vertically. The support shaft 39 rotatably engages one end of the linear movement assembly 36 in the longitudinal direction of the fixing device 20.

As shown in FIGS. 7 and 8, the rotary members 35A and 35B include step portions 45A and 45B, respectively, projecting in the frontward direction F. For example, the step portion 45A is constructed of an upper step 452 and a lower step 451 projecting from the upper step 452 in the frontward direction F. Similarly, the step portion 45B is constructed of the upper step 452 and the lower step 451 projecting from the upper step 452 in the frontward direction F. As the levers 28A and 28B move in the rearward direction B, the levers 28A and 28B press against the lower step 451 of the respective step portions 45A and 45B. That is, the lower step 451 of the respective rotary members 35A and 35B serves as a contact portion contacted by the respective levers 28A and 28B.

As shown in FIG. 6, the linear movement assembly 36 is constructed of a body 41 attached to the rotary member 35B and a detected portion 42 detected by the sensor 37. As shown in FIG. 7, the detected portion 42 is constructed of a tube 43, constituting an upper part of the detected portion 42 extending horizontally, and a support shaft 44 attached to one end of the body 41 in the longitudinal direction of the fixing device 20 and inserted into the tube 43. The detected portion 42 is rotatably supported by the body 41 in such a manner that the detected portion 42 is rotatable about the support shaft 44.

According to this example embodiment, a photo interrupter, that is, a transmission optical sensor, is used as the sensor 37. However, the sensor 37 is not limited to the photo interrupter. For example, a reflection optical sensor or a contact sensor may be used as the sensor 37. The photo interrupter is constructed of a light emitter that emits light and a photo receptor that receives the light emitted by the light emitter. The detected portion 42 interrupts a light beam LB shown in FIG. 7 emitted by the light emitter to the photo receptor. Accordingly, the sensor 37 detects whether or not the light beam LB is interrupted by the detected portion 42, thus detecting the position of the detected portion 42 moved by the levers 28A and 28B through the rotary members 35A and 35B and the body 41. Such movement of the detected portion 42 is described below.

Figure 9:
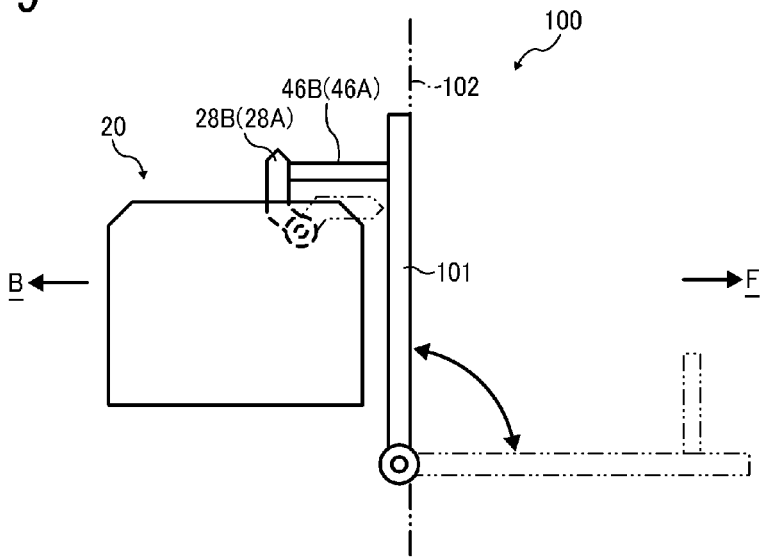
FIG. 9 is a vertical side view of the image forming apparatus shown in FIG. 3.

Referring to FIG. 9, the following describes a positioner installed in the image forming apparatus 100 that positions the levers 28A and 28B described above.

FIG. 9 is a vertical side view of the image forming apparatus 100. As shown in FIG. 9, the image forming apparatus 100 includes a door 101 attached to a cabinet 102 of the image forming apparatus 100 and openable in the frontward direction F by the user. An interior wall of the door 101 mounts a pair of protrusions 46A and 46B serving as a positioner disposed opposite the levers 28A and 28B to position them. For example, as the user closes the door 101 while the levers 28A and 28B depicted in FIGS. 7 and 8 swing in the rearward direction B, the protrusions 46A and 46B come into contact with the levers 28A and 28B, respectively, thus positioning the levers 28A and 28B.

Referring to FIGS. 7 to 13, the following describes an operation of detecting the enhanced pressure position of the depressurization assembly 51 shown in FIG. 4 where the pressing roller 22 presses against the fixing roller 21 with enhanced pressure therebetween.

Figure 10:
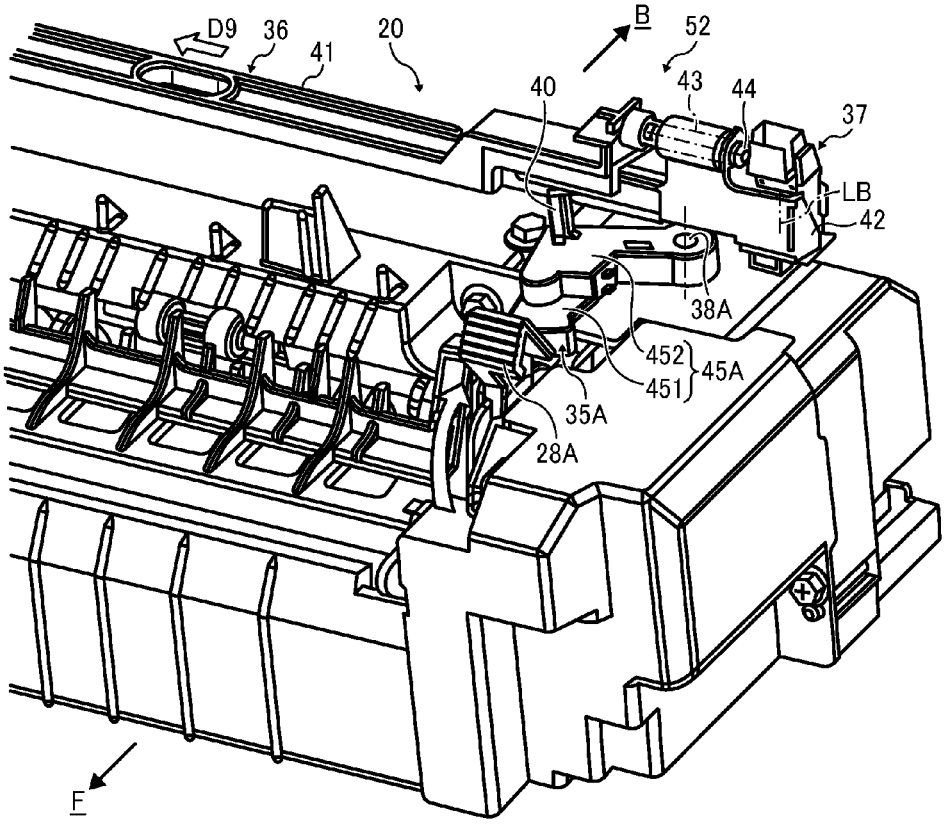
FIG. 10 is a partial external perspective view of the fixing device shown in FIG. 4 illustrating one end of the fixing device in the longitudinal direction thereof before positioning a lever incorporated therein.
Figure 11:
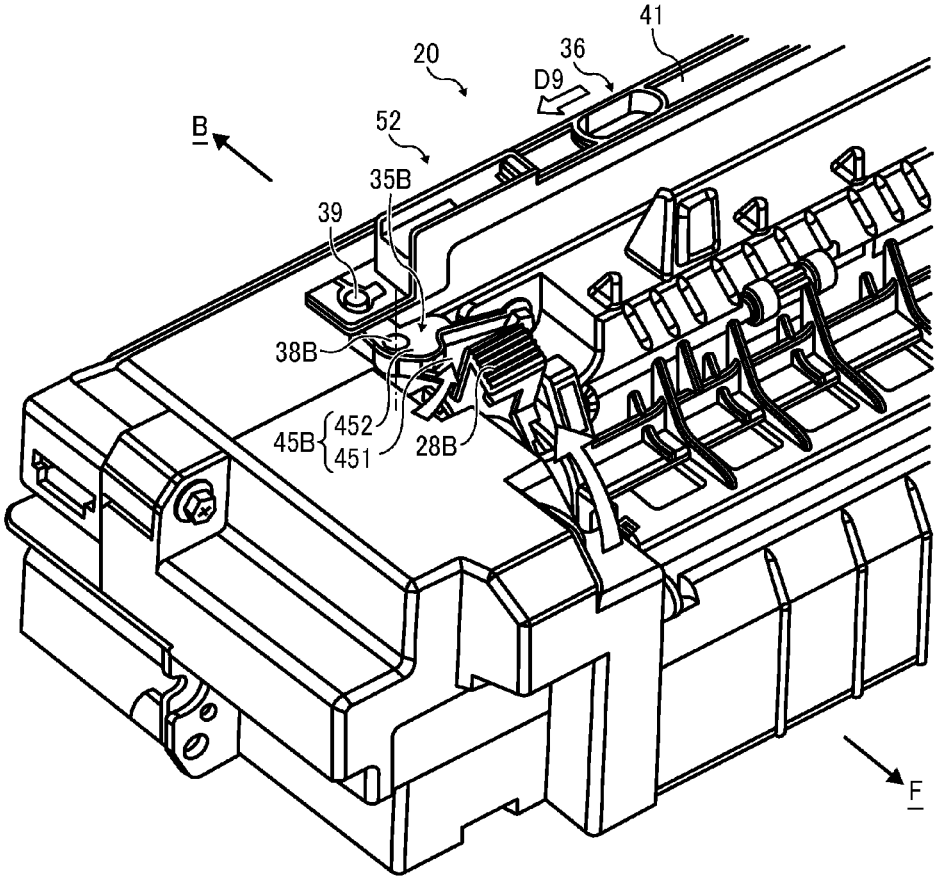
FIG. 11 is a partial external perspective view of the fixing device shown in FIG. 4 illustrating another end of the fixing device in the longitudinal direction thereof before positioning the lever.
Figure 12:
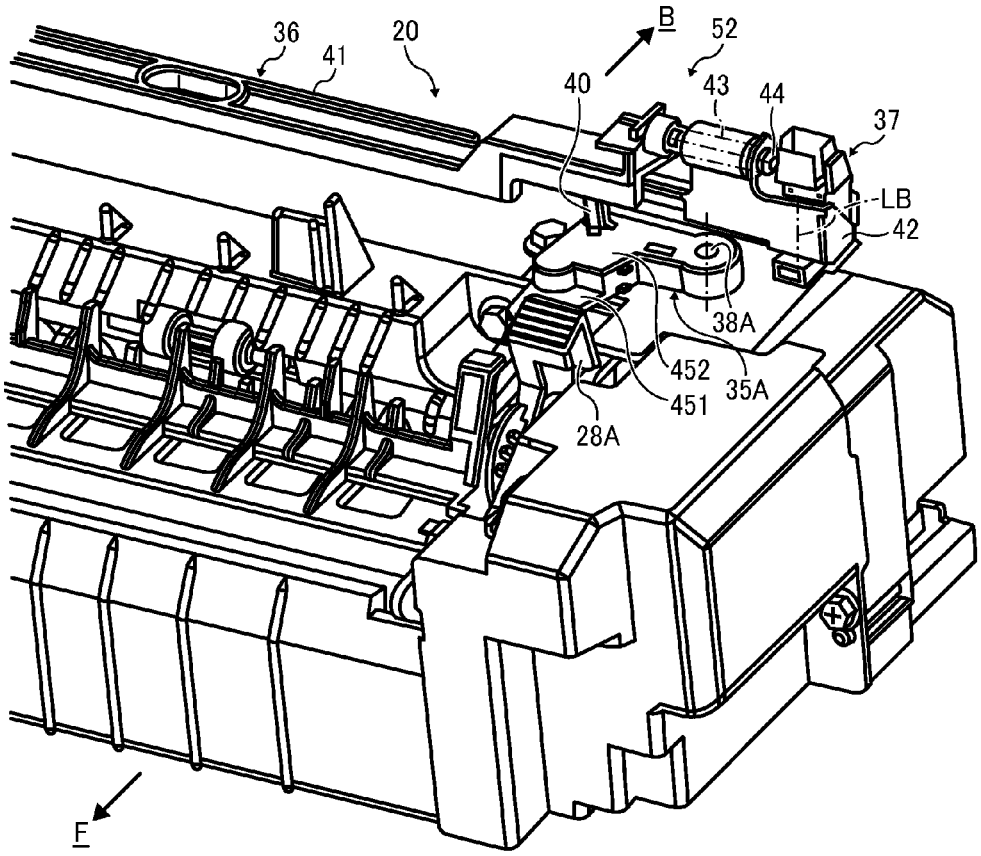
FIG. 12 is a partial external perspective view of the fixing device shown in FIG. 4 illustrating one end of the fixing device in the longitudinal direction thereof after positioning the lever.
Figure 13:
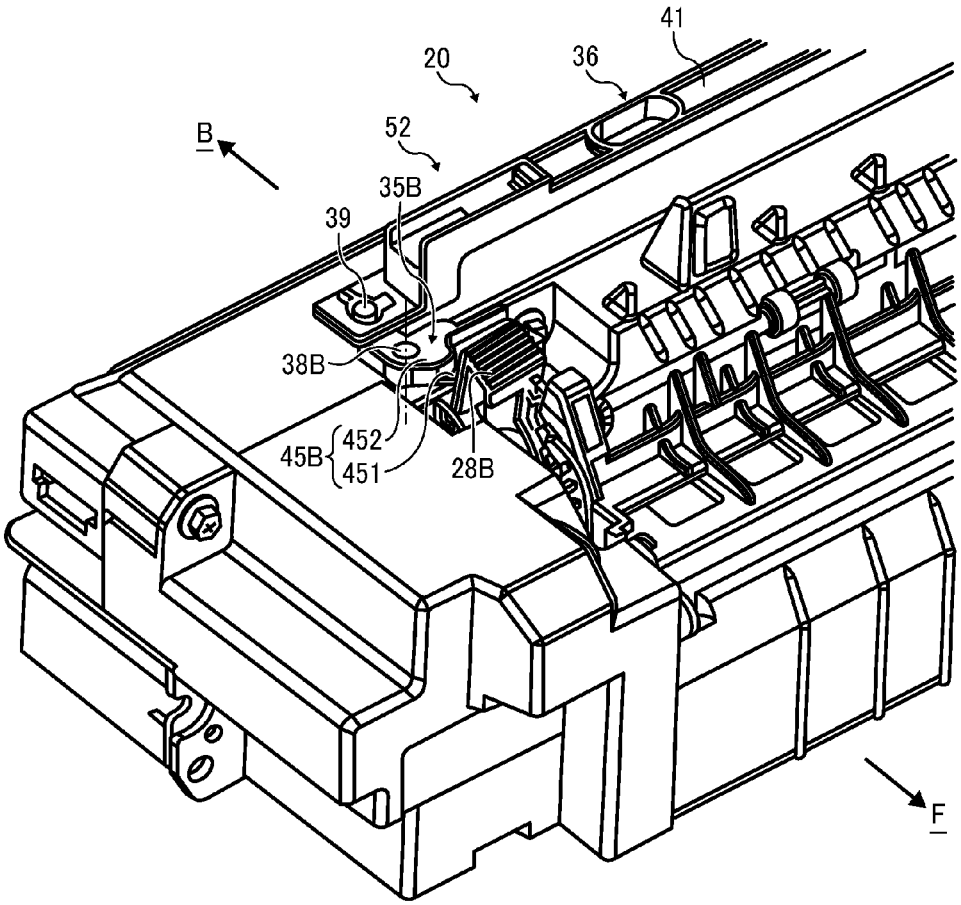
FIG. 13 is a partial external perspective view of the fixing device shown in FIG. 4 illustrating another end of the fixing device in the longitudinal direction thereof after positioning the lever.

FIG. 10 is a partial external perspective view of the fixing device 20 illustrating one end of the fixing device 20 in the longitudinal direction thereof before positioning the lever 28A. FIG. 11 is a partial external perspective view of the fixing device 20 illustrating another end of the fixing device 20 in the longitudinal direction thereof before positioning the lever 28B. FIG. 12 is a partial external perspective view of the fixing device 20 illustrating one end of the fixing device 20 in the longitudinal direction thereof after positioning the lever 28A. FIG. 13 is a partial external perspective view of the fixing device 20 illustrating another end of the fixing device 20 in the longitudinal direction thereof after positioning the lever 28B.

As shown in FIGS. 6 to 8, when the levers 28A and 28B are lowered to extend in the frontward direction F to the reduced pressure position depicted in FIG. 5 where the pressing roller 22 presses against the fixing roller 21 with reduced pressure therebetween, the rotary members 35A and 35B are at the reduced pressure position where the lower steps 451 of the step portions 45A and 45B of the rotary members 35A and 35B, respectively, project in the frontward direction F by a resilient bias exerted by torsion springs 54 serving as a biasing member.

Conversely, as the user swings the levers 28A and 28B in the rearward direction B to the enhanced pressure position shown in FIG. 4 where the pressing roller 22 presses against the fixing roller 21 with enhanced pressure therebetween, the levers 28A and 28B press against the lower steps 451 of the step portions 45A and 45B of the rotary members 35A and 35B, respectively, against the resilient bias exerted by the torsion springs 54 as shown in FIGS. 10 and 11, thus rotating the rotary members 35A and 35B in the rearward direction B. Accordingly, the linear movement assembly 36 connected to the rotary member 35B as shown in FIG. 6 moves in a direction D9 depicted in FIG. 11 in accordance with rotation of the rotary member 35B to the position illustrated in the broken line in FIG. 6.

When the user swings the levers 28A and 28B in the rearward direction B to the enhanced pressure position shown in FIGS. 10 and 11, the levers 28A and 28B are not immovably halted and thereby are idly swingable. For example, at the enhanced pressure position shown in FIG. 4, the lever 28 representing the levers 28A and 28B and the depressurization member 29 do not receive a resilient bias from the spring 27 and therefore the elongate through-hole 33 of the depressurization member 29 is idly movable over the shaft 34 mounted on the fixing plate 24. Accordingly, in a state in which the levers 28A and 28B are idly swingable, the rotary members 35A and 35B contacted by the levers 28A and 28B and the detected portion 42 of the linear movement assembly 36 contacted by the rotary members 35A and 35B are not immovably halted, preventing precise detection of the sensor 37 that detects the detected portion 42.

To address this circumstance, the user closes the door 101 to bring the protrusions 46A and 46B mounted on the door 101 into contact with the levers 28A and 28B as shown in FIG. 9. Hence, the levers 28A and 28B are pressed in the rearward direction B and immovably haled at a predetermined halt position.

FIGS. 12 and 13 illustrate the levers 28A and 28B immovably halted at the predetermined halt position. In a state in which the levers 28A and 28B are immovably halted at the predetermined halt position shown in FIGS. 12 and 13, the rotary members 35A and 35B are pressed in the rearward direction B farther compared to a state in which the levers 28A and 28B are at the enhanced pressure position shown in FIGS. 10 and 11. Accordingly, as shown in FIG. 12, the projection 40 mounted on the rotary member 35A moves under the body 41 of the linear movement assembly 36, thus coming into contact with the detected portion 42 shown in the broken line in FIG. 6. It is to be noted that the detected portion 42 shown in the solid line is moved linearly to the position shown in the broken line by movement of the body 41 in the direction D9 depicted in FIG. 11 to the position shown in the broken line in FIG. 6 caused by rotation of the rotary member 35B pressed by the lever 28B as described above. Consequently, the projection 40 immovably halts the detected portion 42 at the predetermined halt position, allowing the detected portion 42 to interrupt the light beam LB emitted by the light emitter of the sensor 37 precisely. As a result, the sensor 37 detects that the levers 28A and 28B are at the enhanced pressure position shown in FIG. 4 where the pressing roller 22 presses against the fixing roller 21 with enhanced pressure therebetween.

Referring to FIGS. 7 to 13, the following describes an operation of detecting the reduced pressure position of the depressurization assembly 51 shown in FIG. 5 where the pressing roller 22 presses against the fixing roller 21 with reduced pressure therebetween.

As the user opens the door 101 depicted in FIG. 9, that is, as the user lowers the door 101 as shown in the broken line in FIG. 9, the protrusions 46A and 46B mounted on the door 101 are isolated from the levers 28A and 28B, respectively, thus setting the levers 28A and 28B free.

As the levers 28A and 28B are set free, the rotary members 35A and 35B pressed by the levers 28A an 28B in the rearward direction B are rotated in the frontward direction F by a resilient bias exerted by the torsion springs 54 as shown in FIG. 6. The free levers 28A and 28B are pressed by the rotary members 35A and 35B rotated by the torsion springs 54 in the frontward direction F and swing until the levers 28A and 28B reach a position where they receive a resilient bias from the springs 27 as shown in FIGS. 10 and 11. Simultaneously, the projection 40 mounted on the rotary member 35A moves from under the body 41, setting the detected portion 42 free.

As the user swings and lowers the levers 28A and 28B in the frontward direction F against a resilient bias exerted by the springs 27 to the reduced pressure position shown in FIGS. 7 and 8, the levers 28A and 28B separate from the rotary members 35A and 35B, respectively. Accordingly, the rotary members 35A and 35B are rotated by the torsion springs 54 in the frontward direction F until the rotary members 35A and 35B come into contact with detents that halt the rotary members 35A and 35B, respectively, at a predetermined halt position. On the other hand, the linear movement assembly 36 is moved by a resilient member (e.g., a compression spring or a tension spring) in a direction opposite the direction D9 depicted in FIG. 11, allowing the detected portion 42 to interrupt the light beam LB emitted by the light emitter of the sensor 37.

As described above, as the user opens the door 101 depicted in FIG. 9 to press the pressing roller 22 against the fixing roller 21 with reduced pressure therebetween, the rotary members 35A and 35B rotating in the frontward direction F press the levers 28A and 28B in the frontward direction F toward the user, helping the user readily access the levers 28A and 28B.

As shown in FIG. 10, when the lever 28A contacts the rotary member 35A, a gap is created between the lever 28A and the upper step 452 of the step portion 45A of the rotary member 35A. Similarly, as shown in FIG. 11, when the lever 28B contacts the rotary member 35B, a gap is created between the lever 28B and the upper step 452 of the step portion 45B of the rotary member 35B. Accordingly, the user can catch the levers 28A and 28B readily by putting his or her fingers into the gaps and swing the levers 28A and 28B in the frontward direction F.

Compact image forming apparatuses incorporating a fixing device of decreased size may not accommodate space for the fingers of the user that catch the levers 28A and 28B. To address this circumstance, the fixing device 20 according to this example embodiment, even with its compact size, accommodates space for the fingers of the user that catch the levers 28A and 28B, that is, the gaps between the levers 28A and 28B and the upper steps 452 of the step portions 45A and 45B of the rotary members 35A and 35B, enhancing usability of the fixing device 20.

It is sufficient, if a resilient bias exerted by the torsion springs 54 to the rotary members 35A and 35B to rotate them in the frontward direction F is equivalent to a level required to swing the free levers 28A and 28B to a position where the levers 28A and 28B receive a resilient bias from the springs 27. If the resilient bias exerted by the torsion springs 54 is too great, the finger of the user may be nipped between the lever 28A and the rotary member 35A and between the lever 28B and the rotary member 35B, degrading usability of the levers 28A and 28B.

The present invention is not limited to the details of the example embodiments described above, and various modifications and improvements are possible. For example, the number, position, and shape of the components constituting the fixing device 20 may be changed.

As shown in FIG. 6, according to this example embodiment, the position detector 52 includes a linkage constructed of the rotary members 35A and 35B and the linear movement assembly 36. Alternatively, the position detector 52 may employ a linkage between rotary members, a linkage between components that move linearly back and forth, or other linkage.

As shown in FIG. 4, according to this example embodiment, the fixing roller 21 is used as a fixing rotary body and the pressing roller 22 is used as a pressing rotary body. Alternatively, an endless belt such as a fixing belt and a pressing belt may be used as a fixing rotary body and a pressing rotary body. As shown in FIG. 3, the image forming apparatus 100 is a color laser printer. Alternatively, the image forming apparatus 100 may be a monochrome printer, a copier, a facsimile machine, a multifunction printer (MFP) having at least one of copying, printing, facsimile, and scanning functions, or the like.

Referring to FIGS. 3 to 6, the following describes advantages of the fixing device 20.

As shown in FIGS. 3 and 4, the fixing device 20 includes the fixing roller 21 serving as a fixing rotary body; and the pressing roller 22 serving as a pressing rotary body pressed against the fixing roller 21 by the spring 27 serving as a pressurization member to form the fixing nip N between the fixing roller 21 and the pressing roller 22 through which a recording medium P bearing a toner image is conveyed. The depressurization assembly 51 moves the pressing roller 22 to the reduced pressure position shown in FIG. 5 against a resilient bias exerted by the spring 27. The position detector 52 depicted in FIG. 6 detects the position of the depressurization assembly 51 between the enhanced pressure position shown in FIG. 4 where the pressing roller 22 presses against the fixing roller 21 with enhanced pressure therebetween and the reduced pressure position shown in FIG. 5 where the pressing roller 22 presses against the fixing roller 21 with reduced pressure therebetween. When the depressurization assembly 51 is at the enhanced pressure position, it does not receive a resilient bias from the spring 27 and therefore is idly movable. The protrusions 46A and 46B depicted in FIG. 9 serving as a positioner immovably halt the depressurization assembly 51 at the enhanced pressure position.

As described above, even when the levers 28A and 28B of the depressurization assembly 51 are free at the enhanced pressure position shown in FIG. 4 where the pressing roller 22 presses against the fixing roller 21 with enhanced pressure therebetween, the protrusions 46A and 46B serving as a positioner depicted in FIG. 9 press against the levers 28A and 28B to halt them at the predetermined position as shown in FIGS. 12 and 13, causing the levers 28A and 28B to rotate the rotary members 35A and 35B in the rearward direction B as shown in FIGS. 12 and 13. Accordingly, the rotary member 35B moves the body 41 of the linear movement assembly 36 to retract the detected portion 42 from the sensor 37 as shown in the broken line in FIG. 6. Simultaneously, the projection 40 mounted on the rotary member 35A moves under the body 41 of the linear movement assembly 36. Consequently, the projection 40 comes into contact with the detected portion 42 retracted from the sensor 37 and immovably halts the detected portion 42 at the predetermined halt position shown in the broken line in FIG. 6 where the sensor 37 detects precisely that the light beam LB is not interrupted by the detected portion 42 and therefore the levers 28A and 28B are at the enhanced pressure position where the pressing roller 22 presses against the fixing roller 21 with enhanced pressure therebetween, thus enhancing reliability of the fixing device 20 and the image forming apparatus 100 incorporating the fixing device 20.

Improvement in detection of the position of the depressurization assembly 51 constructed of the levers 28A and 28B and the depressurization member 29 attains a configuration in which the depressurization assembly 51 is free at the enhanced pressure position where the pressing roller 22 presses against the fixing roller 21 with enhanced pressure therebetween as shown in FIG. 4, thus achieving advantages below.

For example, when the depressurization assembly 51 is free, it does not receive a resilient bias from the spring 27 serving as a pressurization member. Accordingly, components that move in conjunction with the depressurization assembly 51 also do not receive a resilient bias from the spring 27. The components that move in conjunction with the depressurization assembly 51 are the rotary members 35A and 35B and the linear movement assembly 36 constituting a position detector together with the sensor 37. Since the rotary members 35A and 35B and the linear movement assembly 36 do not receive a resilient bias from the springs 27, they may be made of a material having a mechanical strength smaller than that of metal. According to this example embodiment, the levers 28A and 28B and the depressurization member 29 constitute the depressurization assembly 51. Since the levers 28A and 28B do not receive a resilient bias from the springs 27, the levers 28A and 28B may be also made of a material having a mechanical strength smaller than that of metal.

Accordingly, the levers 28A and 28B, the rotary members 35A and 35B, and the linear movement assembly 36 may be made of resin by injection molding at reduced manufacturing costs with decreased size. For example, the levers 28A and 28B, the rotary members 35A and 35B, and the linear movement assembly 36 may be made of resin such as polycarbonate resin, acrylonitrile-butadiene-styrene resin, acrylonitrile-styrene resin, styrene resin, polyphenylene ether resin, polyphenylene oxide resin, polyacetal resin, polyamide resin, polyether terephthalate resin, alloy resin of these, or the like.

As described above, the sensor 37 detects the position of the depressurization assembly 51 precisely, that is, the enhanced pressure position shown in FIG. 4 where the pressing roller 22 presses against the fixing roller 21 with enhanced pressure therebetween and the reduced pressure position shown in FIG. 5 where the pressing roller 22 presses against the fixing roller 21 with reduced pressure therebetween with the compact fixing device 20 manufactured at reduced costs and the image forming apparatus 100 incorporating the fixing device 20.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body rotatable in a set direction of rotation;

a pressing rotary body pressed against the fixing rotary body to form a fixing nip therebetween through which a recording medium bearing a toner image is conveyed;

a pressurization member connected to the pressing rotary body to press the pressing rotary body against the fixing rotary body;

a depressurization assembly installed at an end of the fixing device in an axial direction and interposed between the pressing rotary body and the pressurization member and movable between a reduced pressure position where the depressurization assembly causes the pressurization member to press the pressing rotary body against the fixing rotary body with reduced pressure therebetween and an enhanced pressure position where the depressurization assembly is free from pressure from the pressurization member to cause the pressurization member to press the pressing rotary body against the fixing rotary body with enhanced pressure therebetween;

a positioner contacting the depressurization assembly to immovably halt the depressurization assembly at the enhanced pressure position; and a position detector contacting the depressurization assembly to detect the position of the depressurization assembly, wherein the fixing rotary body, the pressing rotary body, the pressurization member and the depressurization assembly are inside a housing, and the positioner and the position detector are outside of the housing.

2. The fixing device according to claim 1, wherein the depressurization assembly includes a lever swingable between the reduced pressure position and the enhanced pressure position, and wherein the position detector includes:

a rotary member separatably contacting the lever and rotatable when pressed by the lever;

a movement assembly connected to the rotary member and movable in accordance with rotation of the rotary member; and a sensor disposed opposite the movement assembly to detect movement of the movement assembly.

3. The fixing device according to claim 2, wherein the lever, the rotary member, and the movement assembly are made of resin.

4. The fixing device according to claim 2, further comprising a biasing member attached to the rotary member to exert a bias thereto that rotates the rotary member toward the lever.

5. The fixing device according to claim 4, wherein the biasing member includes a torsion spring.

6. The fixing device according to claim 2, further comprising:

a pressing plate mounting the pressing rotary body;

a fixing plate mounting the fixing rotary body; and a shaft mounted on the fixing plate, wherein the pressurization member is attached to the pressing plate and the fixing plate and the depressurization assembly further includes a depressurization member swingably mounted on the lever and having an elongate through-hole through which the shaft moves as the lever swings between the reduced pressure position and the enhanced pressure position.

7. The fixing device according to claim 2, wherein the movement assembly includes:

a body attached to the rotary member; and a detected portion attached to the body and detectable by the sensor, wherein as the rotary member rotates when pressed by the lever, the rotary member moves the body to separate the detected portion attached to the body from the sensor so that the sensor detects that the lever is at the enhanced pressure position.

8. The fixing device according to claim 7, wherein the position detector further includes a projection mounted on the rotary member, and wherein as the rotary member rotates when pressed by the lever, the projection comes into contact with and immovably halts the detected portion separated from the sensor.

9. The fixing device according to claim 4, wherein the lever swings in a frontward direction to the reduced pressure position and in a rearward direction opposite the frontward direction to the enhanced pressure position.

10. The fixing device according to claim 9, wherein when the positioner separates from the lever, the biasing member rotates the rotary member to swing the lever in the frontward direction.

11. The fixing device according to claim 2, wherein the rotary member includes:

a lower step contacting the lever; and an upper step disposed on the lower step with a gap provided between the lever and the upper step.

12. The fixing device according to claim 1, wherein the fixing rotary body and the pressing rotary body include one of a roller and a belt.

13. The fixing device according to claim 1, wherein the pressurization member includes one of a compression spring and a tension spring.

14. An image forming apparatus comprising the fixing device according to claim 1.

15. The image forming apparatus according to claim 14, further comprising a door attached to a cabinet of the image forming apparatus, wherein the positioner includes a protrusion mounted on the door, and when the door is closed, the protrusion comes into contact with and moves the depressurization assembly to the enhanced pressure position.

16. The fixing device according to claim 1, wherein the depressurization assembly includes:

a lever operated by an user; and a depressurization member swingable mounted on the lever to move in accordance with movement of the lever.

17. The fixing device according to claim 16, wherein the lever includes a head which is swingable about a support shaft.

18. The fixing device according to claim 17, wherein the head includes an anti-slippage sheets having a plurality of pits and projections.

19. The fixing device according to claim 16, wherein the lever swings in a frontward direction from the enhanced pressure position to the reduced pressure position, which causes the lever to extend in a horizontal direction.

20. The fixing device according to claim 19, wherein the depressurization member extends horizontally in accordance with movement of the lever.

* * * * *